US011434912B2

(12) United States Patent
Isogai et al.

(10) Patent No.: US 11,434,912 B2
(45) Date of Patent: Sep. 6, 2022

(54) COMPRESSOR HOUSING FOR TURBOCHARGER AND METHOD FOR MANUFACTURING THE SAME

(71) Applicant: OTICS CORPORATION, Nishio (JP)

(72) Inventors: Tomoyuki Isogai, Aichi (JP); Tetsuya Niwa, Aichi (JP); Ryu Osuka, Aichi (JP)

(73) Assignee: OTICS CORPORATION, Nishio (JP)

( * ) Notice: Subject to any disclaimer, the term of this patent is extended or adjusted under 35 U.S.C. 154(b) by 128 days.

(21) Appl. No.: 16/809,743

(22) Filed: Mar. 5, 2020

(65) Prior Publication Data

US 2020/0325902 A1 Oct. 15, 2020

(30) Foreign Application Priority Data

Apr. 12, 2019 (JP) ..... JP2019-076029
Jun. 12, 2019 (JP) ..... JP2019-109323

(51) Int. Cl.
*F04D 17/10* (2006.01)
*F04D 29/44* (2006.01)
(Continued)

(52) U.S. Cl.
CPC ..... *F04D 17/10* (2013.01); *F04D 29/44* (2013.01); *F04D 29/58* (2013.01);
(Continued)

(58) Field of Classification Search
CPC ..... F04D 17/10; F04D 29/44; F04D 29/58; F04D 29/4206; F04D 29/441;
(Continued)

(56) References Cited

U.S. PATENT DOCUMENTS

2011/0217162 A1* 9/2011 Dillon ..... F04D 29/624 415/207
2013/0039750 A1* 2/2013 Osuka ..... F04D 29/4206 415/204
(Continued)

FOREIGN PATENT DOCUMENTS

JP H06-257472 A 9/1994
JP H11-286999 A 10/1999
JP 2018-184928 A 11/2018

OTHER PUBLICATIONS

Sep. 2, 2020 Search Report issued in European Patent Application No. 20161556.4.
(Continued)

*Primary Examiner* — Courtney D Heinle
*Assistant Examiner* — Andrew J Marien
(74) *Attorney, Agent, or Firm* — Oliff PLC

(57) ABSTRACT

A compressor housing for a turbocharger dividably composed of a plurality of pieces including a scroll piece, and a shroud piece. The scroll piece and the shroud piece are assembled to each other by press-fitting a press-fitting portion of the shroud piece into a press-fitted portion of the scroll piece. Pressure-contacting portions that are provided on either one of the scroll piece and the shroud piece are pressure-contacted with pressure-contacted portions that are provided on the other one of the scroll piece and the shroud piece, respectively. As a result, the pressure-contacting portions plastically flow to form seal parts for sealing the scroll piece and the shroud piece, respectively.

12 Claims, 10 Drawing Sheets

(51) Int. Cl.
*F04D 29/58* (2006.01)
*F04D 29/60* (2006.01)

(52) U.S. Cl.
CPC ..... *F04D 29/5846* (2013.01); *F04D 29/601* (2013.01); *F05D 2230/60* (2013.01); *F05D 2260/20* (2013.01); *F05D 2260/37* (2013.01)

(58) Field of Classification Search
CPC ..... F04D 29/5846; F04D 29/601; F05D 2230/60; F05D 2260/37; F05D 2260/20
See application file for complete search history.

(56) References Cited

U.S. PATENT DOCUMENTS

| | | | | |
|---|---|---|---|---|
| 2016/0273548 | A1* | 9/2016 | Uesugi ..... | F04D 29/584 |
| 2018/0252229 | A1 | 9/2018 | Isogai | |
| 2018/0313361 | A1 | 11/2018 | Niwa et al. | |

OTHER PUBLICATIONS

Apr. 6, 2021 Office Action issued in Japanese Patent Application No. 2019-109323.
Oct. 12, 2021 Office Action issued in Japanese Application No. 2019-109323.

* cited by examiner

COMPRESSOR HOUSING FOR TURBOCHARGER AND METHOD FOR MANUFACTURING THE SAME

CROSS-REFERENCE TO RELATED APPLICATION

The present application claims priorities under 35 U.S.C. § 119 to Japanese Application No. 2019-076029, filed on Apr. 12, 2019, entitled "COMPRESSOR HOUSING FOR TURBOCHARGER", and Japanese Application No. 2019-109323, filed on Jun. 12, 2019, entitled "COMPRESSOR HOUSING FOR TURBOCHARGER AND METHOD FOR MANUFACTURING THE SAME". The contents of these applications are incorporated herein by reference in their entirety.

BACKGROUND OF THE INVENTION

Field of the Invention

The present disclosure relates to a compressor housing for a turbocharger and a method for manufacturing the same.

Description of the Related Art

A turbocharger to be mounted on an internal combustion engine of an automobile, etc. includes a compressor impeller and a turbine impeller, which are housed in a housing. The compressor impeller is disposed in an air flow path that is formed inside a compressor housing. The air flow path is provided with an intake port for sucking in air toward the compressor impeller, a diffuser passage through which compressed air discharged from the compressor impeller passes, and a discharge scroll chamber into which the compressed air passing through the diffuser passage flows. The discharge scroll chamber discharges the compressed air into the internal combustion engine side.

Some internal combustion engines for an automobile, etc. are provided with a positive crankcase ventilation system (hereinafter referred to as PCV) for purifying the inside of a crankcase and/or the inside of a head cover by reflowing blowby gas that has generated in the crankcase in an intake passage. In such a configuration, oil (oil mist) contained in the blowby gas may flow out from the PCV into the intake passage that is located upstream of the compressor in the turbocharger under some circumstances.

At that time, if air pressure at an outlet port of the compressor is high, air temperature there is made high, so that the oil flowing out from the PCV is concentrated and thickened by evaporation to have high viscosity. In some cases, the oil is accumulated as deposit on, for example, the diffuser surface of a compressor housing for a turbocharger and/or the surface of a bearing housing which opposes the diffuser surface. And, there is a risk that the deposit thus accumulated may narrow the diffuser passage to thereby cause reduction in performance of the turbocharger and reduction in output of the internal combustion engine.

In the past, an air temperature at the outlet port of the compressor was controlled to some extent to prevent such deposit accumulation in the diffuser passage as described above. As a result, a turbocharger was not able to satisfactorily exhibit its performance, and the output of an internal combustion engine was not satisfactorily raised.

Patent Document 1 discloses a configuration to prevent deposit accumulation in a diffuser passage, in which a refrigerant flow path is provided inside a compressor housing for a turbocharger to allow a refrigerant to pass therethrough, thereby restraining an increase in the temperature of compressed air passing through an air flow path inside the housing. In the configuration disclosed in Patent Document 1, the compressor housing for a turbocharger is dividably formed of a scroll piece and a shroud piece, and a refrigerant flow path is defined by assembling both pieces.

PRIOR ART LITERATURE

Patent Document

Patent Document 1

JP-A-2018-184928

SUMMARY OF THE INVENTION

In the configuration disclosed in Patent Document 1, leakage of a refrigerant from the refrigerant flow path is curtailed by a seal part formed by press-fitting the shroud piece into the scroll piece. In order to enhance sealability at the seal part to a satisfactory extent, it may be considered to apply a sealing material to the seal parts in the shroud piece and the scroll piece at the time of press-fitting. However, when applying the sealing material, some kind of pretreatment such as preparation of the sealing material, degreasing, etc. is required, which will cause cost increase and deterioration of workability. Alternately, it may be considered to form the seal part with a press-fitting surface on the shroud piece into the scroll piece without using the sealing material to reduce cost and number of working processes, however, this case involves a risk that a micro gap will be formed in the seal part, which may cause leakage of a refrigerant, and leakage defects will occur. The leakage defects can be detected in leakage inspection performed after assembly, so that distribution of defective products to the market can be prevented. However, reduction of the production yield will eventually result in cost increase.

On the other hand, also in the case where a compressor housing for a turbocharger having no refrigerant flow path is dividably formed of a scroll piece and a shroud piece, and both pieces are assembled together by press-fitting, improvement in sealability at a press-fitting portion is required in some cases. In this case, if a sealing material is used as mentioned above, cost increase and reduction in workability will be caused.

The present disclosure has been made in view of this background, and is directed to a compressor housing for a turbocharger in which improvement in sealability can be achieved compatibly with cost reduction.

One aspect of the present disclosure provides a compressor housing for a turbocharger configured to house a compressor impeller, the compressor housing including:

an intake port formation part that defines an intake port configured to suck in air toward the compressor impeller;

a shroud part that surrounds the compressor impeller in a circumferential direction and has a shroud surface facing the compressor impeller;

a diffuser part that is formed on an outer circumferential side of the compressor impeller in the circumferential direction and forms a diffuser passage configured to allow compressed air discharged from the compressor impeller to pass therethrough; and a scroll chamber formation part that forms a scroll chamber configured to guide the compressed air passing through the diffuser passage to outside;

wherein the compressor housing is dividably composed of a plurality of pieces including a scroll piece having at least the intake port formation part and a portion of the scroll chamber formation part, and a shroud piece having at least a portion of the scroll chamber formation part, a portion of the diffuser part, and the shroud part, wherein the scroll piece and the shroud piece are assembled to each other by press-fitting a press-fitting portion of the shroud piece into a press-fitted portion of the scroll piece, and wherein a seal part that seals the scroll piece and the shroud piece is formed by pressure-contacting a pressure-contacting portion that is provided on either one of the scroll piece and the shroud piece with a pressure-contacted portion that is provided on the other one of the scroll piece and the shroud piece so as to cause plastic flow in the pressure-contacting portion.

According to the above-mentioned one aspect of the compressor housing for a turbocharger, the seal part between the scroll piece and the shroud piece is formed by pressure-contacting the pressure-contacting portion that is provided on either one of the scroll piece and the shroud piece with the pressure-contacted portion that is provided on the other one of the scroll piece and the shroud piece so as to cause plastic flow in the pressure-contacting portion. In this way, the pressure-contacting portion plastically flows at the seal part, and a micro gap is filled by the plastic flow, so that improvement in sealability can be achieved differently from the case of forming the seal part by just press-fitting the scroll piece and the shroud piece. In addition, because there is no need to apply a sealing material separately to the seal part, cost reduction can be achieved.

As mentioned above, according to the present aspect, a compressor housing for a turbocharger in which an improvement in sealability is achieved compatibly with cost reduction can be provided.

DETAILED DESCRIPTION OF THE INVENTION

Figure 1:
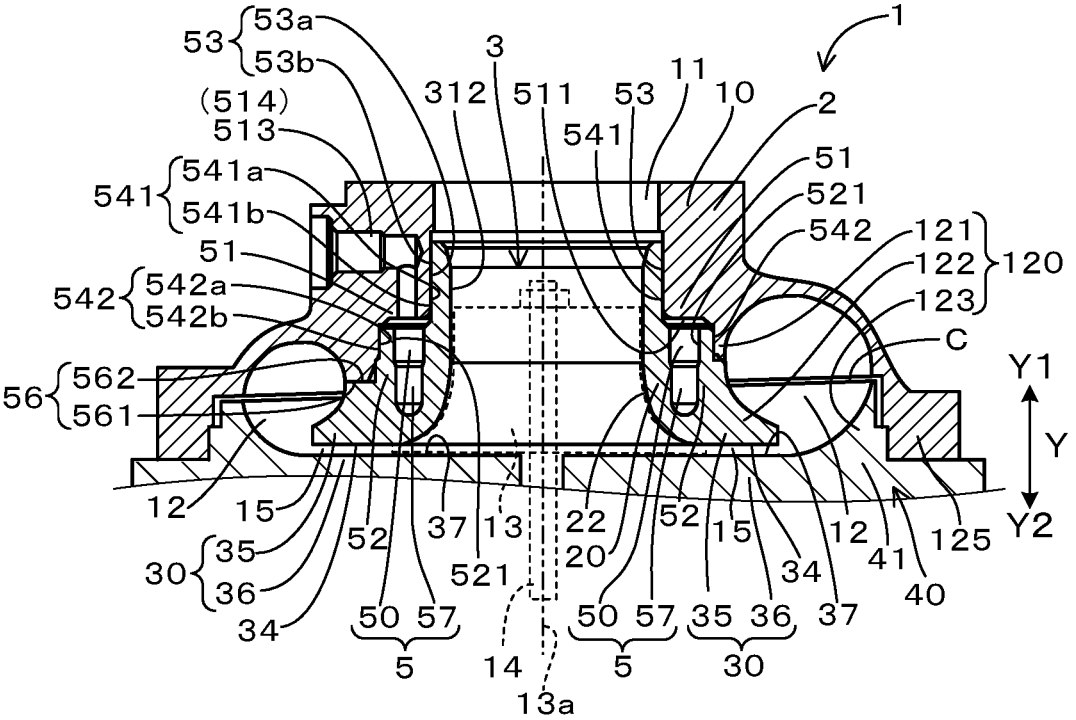
FIG. 1 is a cross-sectional view of a compressor housing for a turbocharger according to Embodiment 1.

"Circumferential direction" in the present specification means the rotation direction of a compressor impeller, "shaft direction" means the direction of the rotation shaft of the compressor impeller, "radial direction" means the radius direction of an imaginary circle centered on the rotation shaft of the compressor impeller, and "outwardly in the radial direction" is defined to be in the direction straightly extending from the center of the imaginary circle to the circumference of the circle.

The compressor housing for a turbocharger further includes a refrigerant flow path that is formed along the diffuser part in the circumferential direction, and allows a refrigerant for cooling the diffuser part to pass therethrough;

wherein the refrigerant flow path is formed as an annular space that is constituted by a first refrigerant flow-path formation part of the scroll piece and a second refrigerant flow-path formation part of the shroud piece, the first refrigerant flow-path formation part and the second refrigerant flow-path formation part being formed respectively at each opposing part of the scroll piece and the shroud piece which oppose each other, wherein the seal part includes an inner circumferential seal part configured to seal the refrigerant flow path on the inner circumferential side thereof, and an outer circumferential seal part configured to seal the refrigerant flow path on the outer circumferential side thereof, wherein the inner circumferential seal part is formed by pressure-contacting an inner circumferential pressure-contacting portion that is provided on either one of the scroll piece and the shroud piece with an inner circumferential pressure-contacted portion that is provided on the other one of the scroll piece and the shroud piece so as to cause plastic flow in the inner circumferential pressure-contacting portion, and wherein the outer circumferential seal part is formed by pressure-contacting an outer circumferential pressure-contacting portion that is provided on either one of the scroll piece and the shroud piece with an outer circumferential pressure-contacted portion that is provided on the other one of the scroll piece and the shroud piece so as to cause plastic flow in the outer circumferential pressure-contacting portion. According to such a configuration, in the compressor housing for a turbocharger having the refrigerant flow path provided therein, improvement in sealability can be achieved compatibly with cost reduction.

The seal part is preferably located on further rear side in a press-fitting portion inserting direction with respect to the press-fitting portion. In this case, when the shroud piece is assembled to the scroll piece, the pressure-contacting portion is pressure-contacted with the pressure-contacted portion after the press-fitting portion is press-fitted into the press-fitted portion, so that dispersal of a plastic flow portion of the seal part can be curtailed. Therefore, the sealability can be surely improved.

Another aspect of the present disclosure provides a method for manufacturing a compressor housing for a turbocharger according to claim 1, the method including:

molding the scroll piece and the shroud piece by die-casting;

forming the pressure-contacting portion on either one of the scroll piece and the shroud piece and the pressure-contacted portion on the other one of the scroll piece and the shroud piece by machining; and assembling the shroud piece to the scroll piece by press-fitting the press-fitting portion into the press-fitted portion, and by pressure-contacting the pressure-contacting portion with the pressure-contacted portion so as to cause plastic flow in the pressure-contacting portion to thereby form the seal part.

According to this configuration, the above-mentioned compressor housing for a turbocharger can be manufactured. Because the pressure-contacting portion and the pressure-contacted portion are formed by machining, the surfaces thereof can be made rough to some extent in comparison with a cast surface made by die-casting, which makes it possible to easily cause plastic flow in the pressure-contacting portion in the assembling, so that the sealability can be further enhanced.

In the machining, the pressure-contacting portion is preferably formed by machining in a mountain shape that protrudes in the radial direction in a cross section including the rotation axis of the compressor impeller, having a front-end side inclined plane that is located on the front-end side in the press-fitting portion inserting direction and a rear-end side inclined plane that is located on the rear-end side in the inserting direction such that an acute-angle between the rear-end side inclined plane and the rotation axis is set larger than an acute-angle between the front-end side inclined plane and the rotation axis in the cross section. In this case, the pressure-contacting portion is shaped by machining such that the rear-end side inclined plane stands more steeply with respect to the rotational axis than the front-end side inclined plane does, so that the width of the pressure-contacting portion can be narrowed with the inclination angle of the front-end side inclined plane and the protruding amount of the pressure-contacting portion being kept unchanged. Thus, in the assembling step, plastically flow in the pressure-contacting portion is easily caused without deterioration of assemblability. Consequently, at each seal part formed in the assembling step, a micro gap can be filled more surely, so that the sealability can be further improved. Otherwise, by narrowing the width of the pressure-contacting portion with the plastic flow amount of the pressure-contacting portion being kept unchanged, dimension tolerances in the pressure-contacting portion and the pressure-contacted portion can be eased in the machining. As a result, productivity can be improved and cost reduction can be achieved.

EMBODIMENTS

Embodiment 1

Hereinafter, embodiments of the above-mentioned compressor housing for a turbocharger will be described with reference to FIGS. 1 to 7.

As shown in FIG. 1, a compressor housing 1 for a turbocharger has a compressor impeller 13 housed therein, and is provided with an intake port formation part 10, a shroud part 20, a diffuser part 30, and a scroll chamber formation part 120.

The intake port formation part 10 defines an intake port 11 configured to suck in air toward the compressor impeller 13.

The shroud part 20 surrounds the compressor impeller 13 in the circumferential direction and has a shroud surface 22 facing the compressor impeller 13.

The diffuser part 30 is formed on the outer circumferential side of the compressor impeller 13 in the circumferential direction and forms a diffuser passage 15 configured to allow compressed air discharged from the compressor impeller 13 to pass therethrough.

The scroll chamber formation part 120 forms a scroll chamber 12 configured to guide the compressed air passing through the diffuser passage 15 to outside.

And the compressor housing 1 is dividably composed of a plurality of pieces including the scroll piece 2 and the shroud piece 3.

The scroll piece 2 has at least the intake port formation part 10 and a portion of the scroll chamber formation part 120.

The shroud piece 3 has at least a portion of the scroll chamber formation part 120, a portion of the diffuser part 30, and the shroud part 20.

The scroll piece 2 and the shroud piece 3 are assembled to each other by press-fitting a press-fitting portion 53*b* of the shroud piece 3 into a press-fitted portion 53*a* of the scroll piece 2. In addition, seal parts 541 and 542 that seal the scroll piece 2 and the shroud piece 3 are formed by pressure-contacting pressure-contacting portions 541*b* and 542*b* that are provided on the shroud piece 3 with pressure-contacted portions 541*a* and 542*a* that are provided on the scroll piece 2 so as to cause plastic flow in the pressure-contacting portions 541*b* and 542*b*.

Hereinafter, the compressor housing 1 for a turbocharger according to the present embodiment will be described in detail.

As shown in FIG. 1, the compressor housing 1 is dividably formed of the scroll piece 2 and the shroud piece 3 that have been prepared separately. And the compressor housing 1 is attached to a flange part, or a seal plate 40 formed in the case of dividable structure, of a bearing housing (not shown in any figure) that houses a bearing unit for bearing a shaft 14 on one end of which the compressor impeller 13 is attached.

Figure 2:
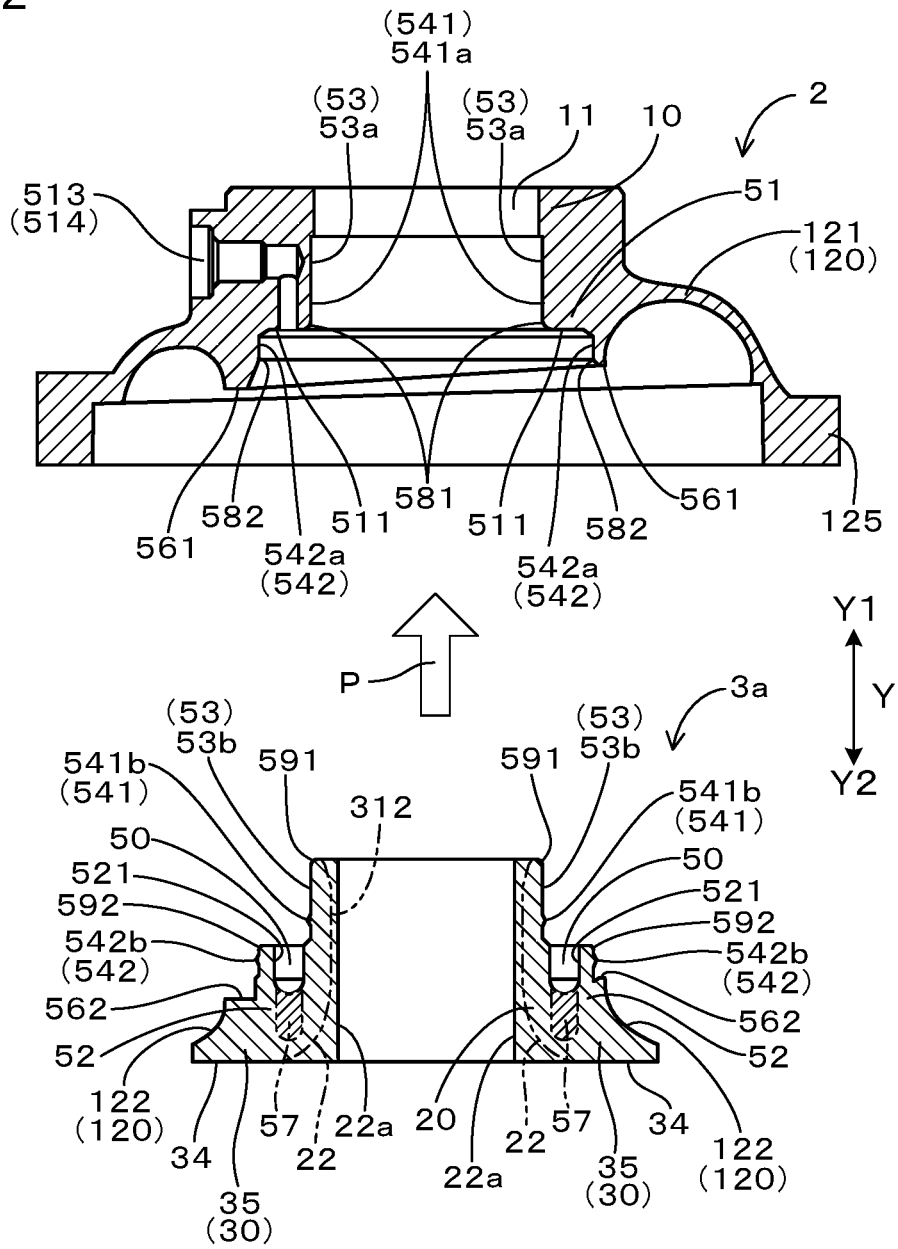
FIG. 2 is a schematic diagram for illustrating a method for manufacturing the compressor housing for a turbocharger according to Embodiment 1.
Figure 3:
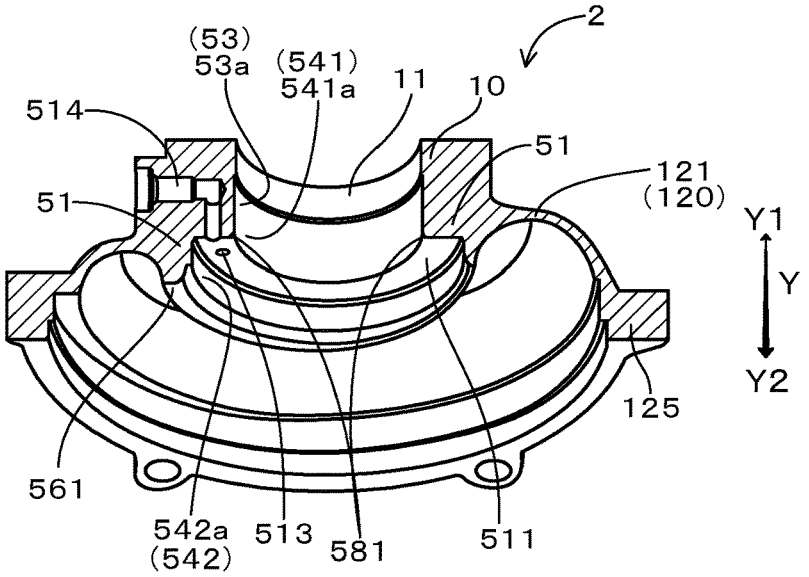
FIG. 3 is a perspective, cross-sectional view of a scroll piece according to Embodiment 1.

As shown in FIGS. 2 and 3, the scroll piece 2 includes the intake port formation part 10, a first scroll chamber formation part 121, an outer peripheral portion 125, and a first refrigerant flow-path formation part 51. As shown in FIG. 2, the shroud piece 3 includes a second scroll chamber formation part 122, the shroud part 20, a first diffuser part 35, and a second refrigerant flow-path formation part 52.

As shown in FIGS. 2 and 3, the intake port formation part 10 of the scroll piece 2 has a cylindrical shape penetratingly formed in the shaft direction Y. The first scroll chamber formation part 121 constitutes a wall surface of the scroll chamber 12 on an intake side Y1. As shown in FIG. 1, the outer peripheral portion 125 is located on a side Y2 that is opposite to the intake side Y1 to form an outer peripheral portion of the compressor housing 1. And, the seal plate 40 is attached inside the outer peripheral portion 125.

As shown in FIG. 1, the second scroll chamber formation part 122 of the shroud piece 3 constitutes a wall surface of the scroll chamber 12 on the inner circumferential side. The shroud part 20 forms the shroud surface 22 that faces the compressor impeller 13. The first diffuser part 35 forms a diffuser surface 34 that extends from the shroud surface 22 toward the scroll chamber 12. It is noted that as shown in FIG. 2, the outer peripheral edge of the shroud piece 3 at the tip end on the intake side Y1 is chamfered to form a third chamfered portion 591.

Figure 4:
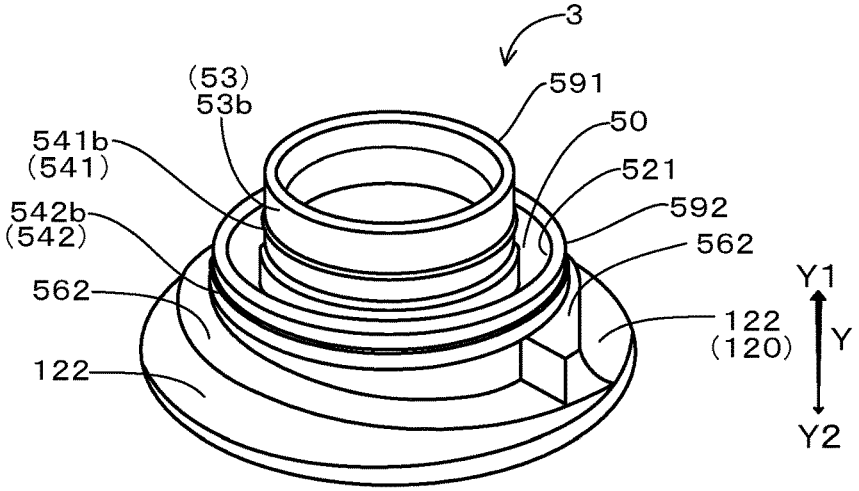
FIG. 4 is a perspective view of a shroud piece according to Embodiment 1.
Figure 5:
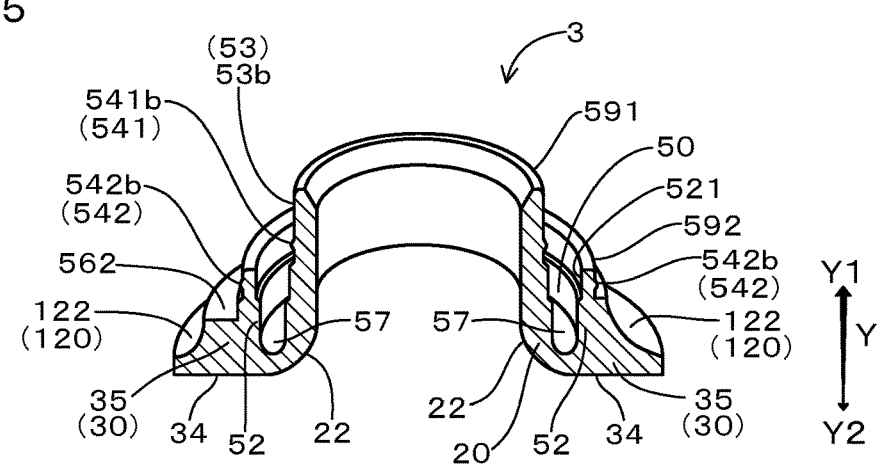
FIG. 5 is a perspective, cross-sectional view of the shroud piece according to Embodiment 1.

As shown in FIGS. 1 and 2, the intake port formation part 10 of the scroll piece 2 has the press-fitted portion 53*a* provided on the side Y2 opposite to the intake side Y1. As shown in FIG. 3, the press-fitted portion 53*a* has a cylindrical inner peripheral surface. As shown in FIG. 1, the shroud piece 3 has the press-fitting portion 53*b* provided on the intake side Y1. As shown in FIGS. 4 and 5, the press-fitting portion 53*b* has a cylindrical outer peripheral surface. And, as shown in FIGS. 1 and 2, the press-fitting portion 53*b* of the shroud piece 3 is press-fitted into the inside of the press-fitted portion 53*a* of the scroll piece 2, and the shroud piece 3 is assembled to the scroll piece 2. The press-fitting portion 53*b* and the press-fitted portion 53*a* are in contact with each other entirely in the circumferential direction. It is noted that a tightening margin of the press-fitting portion 53*b* and the press-fitted portion 53*a* can be set in the range such that sufficient slip-out load can be obtained and no breakage will be caused. In the present embodiment, the scroll piece 2 and the shroud piece 3 are made of an aluminum alloy, and the tightening margin of both is set within the range of 40±20 μm.

As shown in FIG. 1, a refrigerant flow path 5 is defined by the first refrigerant flow-path formation part 51 of the scroll piece 2 and the second refrigerant flow-path formation part 52 of the shroud piece 3 by assembling the shroud piece 3 to the scroll piece 2. As shown in FIG. 3, the first refrigerant flow-path formation part 51 of the scroll piece 2 is located inside the first scroll chamber formation part 121, and has a first wall surface 511 that is a wall surface of the refrigerant flow path 5 on the intake side Y1. In the present embodiment, the first wall surface 511 forms a flat surface that is perpendicular to the axial direction Y, however, the first wall surface 511 is not necessarily flat, and may be recessed toward the intake side Y1. It is noted that as shown in FIG. 2, the corner portion that connects the first wall surface 511 and the inner circumferential pressure-contacted portion 541*a* to be described later is chamfered to form a first chamfered portion 581.

As shown in FIG. 1, the second refrigerant flow-path formation part 52 of the shroud piece 3 is provided on the first diffuser part 35 on the intake side Y1. As shown in FIG. 5, the second refrigerant flow-path formation part 52 has a second wall surface 521 that is formed in a recessed shape recessed toward the Y2 side opposite to the intake side Y1. In the present embodiment, the second wall surface 521 is recessively formed in a U-shape in the cross section parallel to the shaft direction Y, and forms an annular recess that extends in the circumferential direction outside of the shroud surface 22 in the radial direction as shown in FIG. 5. As shown in FIG. 1, the second refrigerant flow-path formation part 52 has the second contact surface 562 that forms a wall surface parallel to the radial direction outside the second wall surface 521 in the radial direction. As shown in FIG. 1, the second contact surface 562 is in contact with the first contact surface 561 of the scroll piece 2. And, an annular space 50 that is defined by the first refrigerant flow-path formation part 51 and the second refrigerant flow-path formation part 52 is formed as the refrigerant flow path 5. The refrigerant flow path 5 is formed along the diffuser part 30 in the circumferential direction, and allows a refrigerant for cooling the diffuser part 30 to pass therethrough. It is noted that as shown in FIG. 2, the corner portion (an end part of the outer circumferential pressure-contacted portion 542*a* on the Y2 side) that connects the first contact surface 561 of the scroll piece 2 and the outer circumferential pressure-contacting portion 542*a* to be described later is chamfered to form a second chamfered portion 582.

As shown in FIG. 1, with regard to the refrigerant flow path 5, the boundary between the first refrigerant flow-path formation part 51 and the second refrigerant flow-path formation part 52 is sealed by the seal parts 541 and 542. The seal part 541 (542) is formed by pressure-contacting the pressure-contacting portion 541*b* (542*b*) with the pressure-contacted portion 541*a* (542*a*) so as to cause plastic flow substantially in the pressure-contacting portion 541*b* (542*b*). The present embodiment includes an inner circumferential seal part 541 for sealing the refrigerant flow path 5 on the inner circumferential side thereof, and an outer circumferential seal part 542 for sealing the refrigerant flow path 5 on the outer circumferential side thereof as the seal parts 541 and 542, respectively. The inner circumferential seal part 541 is composed of the inner circumferential pressure-contacted portion 541*a* and the inner circumferential pressure-contacting portion 541*b*, and the outer circumferential seal part 542 is composed of the outer circumferential pressure-contacted portion 542*a* and the outer circumferential pressure-contacting portion 542*b*.

Figure 6A:
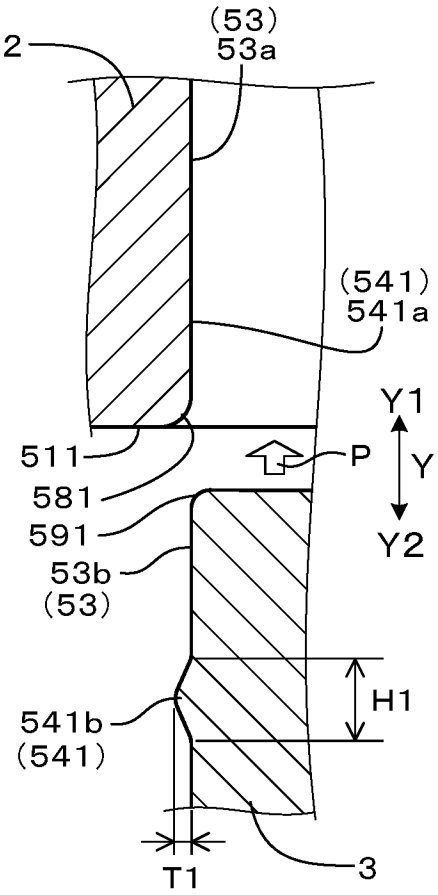
FIGS. 6A, 6B, and 6C are a series of schematic diagrams of an enlarged substantial part for illustrating a method for manufacturing a compressor housing for a turbocharger according to Embodiment 1.

As shown in FIG. 3, with regard to the inner circumferential seal part 541, the inner circumferential pressure-contacted portion 541*a*, which is formed on the scroll piece 2, is located on further Y2 side with respect to the press-fitted portion 53*a* to form a cylindrical inner peripheral surface continuously to the press-fitted portion 53*a*. On the other hand, the inner circumferential pressure-contacting portion 541*b*, which is formed on the shroud piece 3 as shown in FIGS. 4 and 5, is located on further Y2 side with respect to the press-fitting portion 53*b*, that is, on the rear side in the inserting direction of the press-fitting portion 53*b* to form a cylindrical outer peripheral surface continuously to the press-fitting portion 53*b*. The inner circumferential pressure-contacting portion 541*b* in the non-assembled state protrudes outward in the radial direction. Although the shape of the inner circumferential pressure-contacting portion 541*b* is not limited, in the present embodiment, the inner circumferential pressure-contacting portion 541*b* is formed in a mountain shape that protrudes outward in the radial direction, having rising portions smoothly continuous forward and backward respectively in the axial direction Y in a cross section including a rotation axis 13*a* of the compressor impeller 13, as shown in FIG. 6A. In addition, the top of the inner circumferential pressure-contacting portion 541*b* in the protruding direction is also smoothly curved in the cross section. Furthermore, as shown in FIG. 4, the inner circumferential pressure-contacting portion 541*b* is continuous in the circumferential direction to form an annular shape.

As shown in FIG. 6A, the inner circumferential pressure-contacting portion 541*b* in the non-assembled state protrudes outward from the press-fitting portion 53*b* in the radial direction in a protrusion amount T1 predetermined with respect to the press-fitting portion 53*b* in the cross section including the rotation axis 13*a*. The protrusion amount T1 may be set in the range where the inner circumferential pressure-contacting portion 541*b* can plastically flow, and may be set to, for example, 80 μm-120 μm. In the present embodiment, it is set to 100 μm. Although the length in the axial direction Y, of the inner circumferential pressure-contacting portion 541*b*, that is, a formation range H1 in the axial direction Y, of the inner circumferential pressure-contacting portion 541*b* is not particularly limited, it may be set to, for example, 0.5 to 1.5 mm. In the present embodiment, it is set to 1.0 mm.

As shown in FIG. 6A, the inner circumferential pressure-contacting portion 541*b* protrudes in the protrusion amount T1 predetermined with respect to the press-fitting portion 53*b*, and thus, the inner circumferential pressure-contacting portion 541*b* of the shroud piece 3 is press-contacted with the inner circumferential pressure-contacted portion 541*a* of the scroll piece 2 by press-fitting the press-fitting portion 53*b* of the shroud piece 3 into the press-fitted portion 53*a* of the scroll piece 2, so that plastic flow is caused substantially in the inner circumferential pressure-contacting portion 541*b* as shown by a sign M. As a result, a micro gap between both is filled to form the inner circumferential seal part 541. It is noted that although in the present embodiment, the shroud piece 3 is provided with the inner circumferential pressure-contacting portion 541*b*, and the scroll piece 2 is provided with the inner circumferential pressure-contacted portion 541*a*, instead of such a configuration, the inner circumferential pressure-contacted portion 541*a* may be provided on the shroud piece 3, and the inner circumferential pressure-contacting portion 541*b* may be provided on the scroll piece 2. In this regard, it is preferable to provide the inner circumferential pressure-contacted portion 541*a* on either piece that has a higher rigidity than the other does.

Figure 7A:
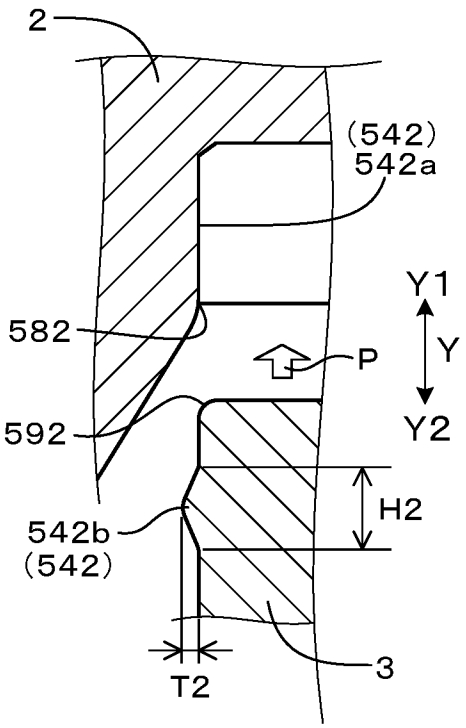
FIGS. 7A, 7B, and 7C are a series of schematic diagrams of an enlarged substantial part for illustrating a method for manufacturing a compressor housing for a turbocharger according to Embodiment 1.

As shown in FIG. 7A, also with regard to the outer circumferential seal part 542, the outer circumferential pressure-contacting portion 542*b* protrudes outward in the radial direction in the same manner as the inner circumferential pressure-contacting portion 541*b*. A protrusion amount T2 and a formation range H2, of the outer circumferential pressure-contacting portion 542*b* may be set to be equivalent to the protrusion amount T1 and the formation range H1, of the inner circumferential pressure-contacting portion 541*b*. In the present embodiment, the T2 and the H2 are set to the same values as those of the T1 and the H1. It is noted that at the end part on the intake side Y1 of the wall surface having the outer circumferential pressure-contacting portion 542*b* provided thereon, its outer peripheral edge is chamfered to form a fourth chamfered portion 592. Then, by press-fitting the press-fitting portion 53*b* of the shroud piece 3 into the press-fitted portion 53*a* of the scroll piece 2, the outer circumferential pressure-contacting portion 542*b* of the shroud piece 3 is pressure-contacted with the outer circumferential pressure-contacted portion 542*a* of the scroll piece 2, so that plastic flow is caused as shown the sign M substantially in the outer circumferential pressure-contacting portion 542*b*, as shown in FIG. 7C. As a result, a micro gap between both is filled to form the outer circumferential seal part 542. It is noted that although in the present embodiment, the shroud piece 3 is provided with the outer circumferential pressure-contacting portion 542*b*, and the scroll piece 2 is provided with the outer circumferential pressure-contacted portion 542*a*, instead of such a configuration, the outer circumferential pressure-contacted portion 542*a* may be provided on the shroud piece 3, and the outer circumferential pressure-contacting portion 542*b* may be provided on the scroll piece 2. In this regard, it is preferable to provide the outer circumferential pressure-contacted portion 542*a* on either piece that has a higher rigidity than the other does.

As shown in FIGS. 1 and 2, the scroll piece 2 has a refrigerant feed part 513 and a refrigerant discharge part 514 that are formed as through-holes formed through the first refrigerant flow-path formation part 51 and communicated with the refrigerant flow path 5. The refrigerant feed part 513 is configured to feed a refrigerant to the refrigerant flow path 5, and the refrigerant discharge part 514 is configured to discharge the refrigerant. In the present embodiment, the refrigerant feed part 513 and the refrigerant discharge part 514 are formed from the first wall surface 511 toward the intake side Y1 in parallel to the axial direction Y, and then directed outward in the radial direction.

The seal plate 40 has a third scroll chamber formation part 123, a seal plate insertion portion 41, and a second diffuser part 36 as shown in FIG. 1. The third scroll chamber formation part 123 constitutes a wall surface of the scroll chamber 12 on the outer circumference side. The seal plate insertion portion 41 is inserted into the inside of the outer peripheral portion 125. The second diffuser part 36 constitutes the diffuser part 30 with the first diffuser part 35. The second diffuser part 36 has a facing surface 37 that faces the diffuser surface 34 of the first diffuser part 35 spaced at a predetermined distance. The space formed between the diffuser surface 34 and the facing surface 37 defines the diffuser passage 15. It is noted that as shown in FIG. 1, the first scroll chamber formation part 121 of the scroll piece 2 and the third scroll chamber formation part 123 of the seal plate 40 are configured so as not to be in contact with each other, having a small gap C therebetween. According to such a configuration, the seal plate 40 is inserted into a predetermined position, and the diffuser passage 15 is formed in a predetermined width.

Next, a manufacturing method of the compressor housing 1 for a turbocharger according to the present embodiment will be described.

First of all, as shown in FIG. 2, the scroll piece 2 and a shroud piece precursor 3*a* serving as a raw material for the shroud piece 3 are separately molded by die casting. Then, by machining, the press-fitted portion 53*a*, the inner circumferential pressure-contacted portion 541*a*, and the outer circumferential pressure-contacted portion 542*a* are formed on the scroll piece 2, and the press-fitting portion 53*b*, the inner circumferential pressure-contacting portion 541*b*, and the outer circumferential pressure-contacting portion 542*b* are formed on the shroud piece 3. And, a cut part 57 that is a bottom portion of the second wall surface 521 is cut. It is noted that the shroud piece precursor 3*a* has no shroud surface 22 formed thereon, and an inside surface 22*a* of the shroud piece precursor 3*a* is formed of a cylindrical surface.

Figure 6B:
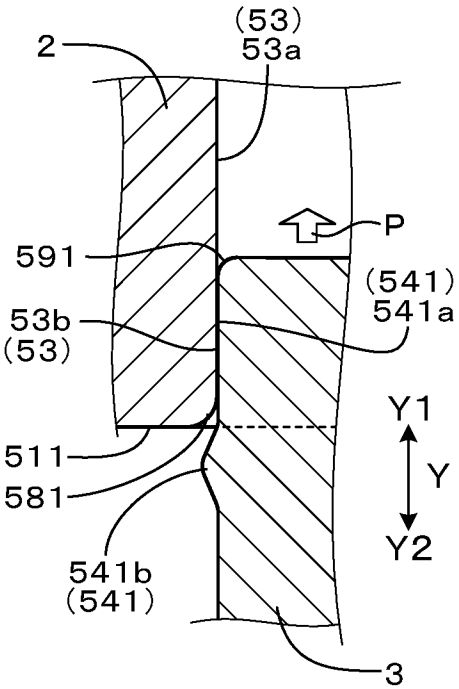
Figure 6C:
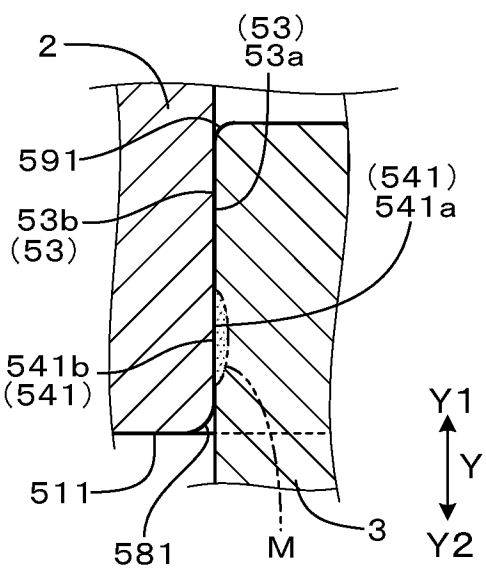

Next, the shroud piece 3 is assembled to the scroll piece 2 in the assembling step as shown by an arrow P in FIG. 2. In more detail, with regard to the inner circumferential seal part 541, the press-fitting portion 53*b* of the shroud piece 3 is inserted toward the inner circumferential pressure-contacted portion 541*a* of the scroll piece 2 in the axial direction Y as shown by the arrow P in FIG. 6A, and then the press-fitting portion 53*b* is press-fitted into the inner circumferential pressure-contacted portion 541*a* as shown in FIG. 6B. And, by further inserting in the direction shown by the arrow P, the press-fitting portion 53*b* is press-fitted so as to reach the press-fitted portion 53*a* that is located on further intake side Y1 with respect to the inner circumferential pressure-contacted portion 541*a* as shown in FIG. 6C. In association with this action, the inner circumferential pressure-contacting portion 541*b* of the shroud piece 3 is brought in contact with the first chamfered portion 581, and the inner circumferential pressure-contacting portion 541*b* is substantially caused to plastically flow along the inner circumferential pressure-contacted portion 541*a* of the scroll piece 2. Consequently, as shown in FIG. 6C, the inner circumferential pressure-contacting portion 541*b* is brought in close contact with the inner circumferential pressure-contacted portion 541*a* of the scroll piece 2. Then, the second contact surface 562 of the shroud piece 3 is press-fitted so as to abut on the first contact surface 561 of the scroll piece 2, thus the inner circumferential seal part 541 is completely formed.

Figure 7B:
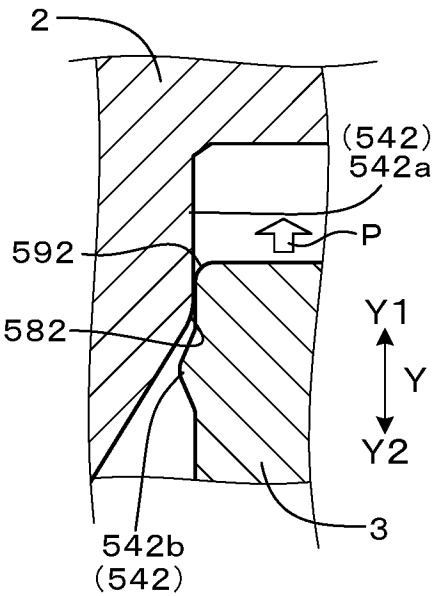
Figure 7C:
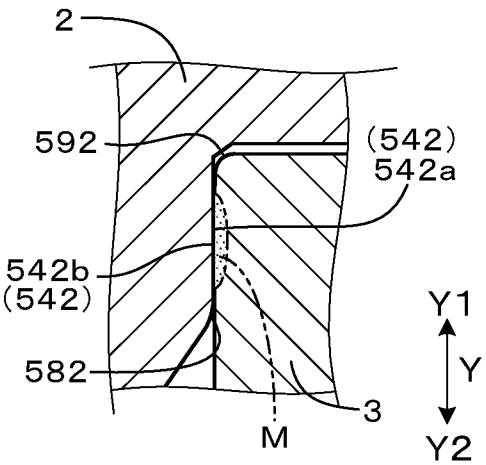

Also in the outer circumferential seal part 542, in association with the action that the press-fitting portion 53*b* of the shroud piece 3 is press-fitted into the press-fitted portion 53*a* of the scroll piece 2, the outer circumferential pressure-contacting portion 542*b* of the shroud piece 3 is brought in contact with the second chamfered portion 582 of the scroll piece 2 as shown in FIGS. 7A and 7B in the same manner as in the inner circumferential seal part 541, and the outer circumferential pressure-contacting portion 542*b* is substantially caused to plastically flow along the outer circumferential pressure-contacted portion 542*a* of the scroll piece 2, so that the outer circumferential pressure-contacting portion 542*b* is brought in close contact with the outer circumferential pressure-contacted portion 542*a* of the scroll piece 2 as shown in FIG. 7C. Thus, the outer circumferential seal part 542 is completely formed. As a result, the refrigerant flow path 5 serving as the annular space 50 that is sealed with the inner circumferential seal part 541 and the outer circumferential seal part 542 is formed as shown in FIG. 1. Then, the shroud surface 22 is formed by machining the inside surface 22*a*. In this way, the compressor housing 1 for a turbocharger as shown in FIG. 1 is manufactured.

In the compressor housing 1 for a turbocharger, a refrigerant introduction tube and a refrigerant discharge tube, which are not shown in any figure, are connected respectively to the refrigerant feed part 513 and the refrigerant discharging part 514 each communicated with the refrigerant flow path 5 as shown in FIGS. 1 and 2. The diffuser surface 34 can be cooled by circulating the refrigerant in the refrigerant flow path 5 via these tubes.

It is noted that although in the inner circumferential seal part 541 according to the present embodiment, the scroll piece 2 is provided with the inner circumferential pressure-contacted portion 541*a*, and the shroud piece 3 is provided with the inner circumferential pressure-contacting portion 541*b*, the inner circumferential pressure-contacting portion 541*b* may be provided on the scroll piece 2, and the inner circumferential pressure-contacted portion 541*a* may be provided on the shroud piece 3. Similarly, in the outer circumferential seal part 542, the scroll piece 2 is provided with the outer circumferential pressure-contacted portion 542*a*, and the shroud piece 3 is provided with the outer circumferential pressure-contacting portion 542*b*. Alternatively, the outer circumferential pressure-contacting portion 542*b* may be provided on the scroll piece 2, and the outer circumferential pressure-contacted portion 542*a* may be provided on the shroud piece 3. In this regard, it is preferable to provide the pressure-contacted portions 541*a* and 542*a* on either piece that has a higher rigidity than the other does.

It is noted that although in the present embodiment, the press-fitting portion 53*b* is provided at further Y1 side than the location of the inner circumferential pressure-contacting portion 541*b* of the shroud piece 3 in order to curtail dispersal of a plastic flow portion, instead of or concurrently with such a configuration, the press-fitting portion may be formed on further Y1 side with respect to the outer circumferential pressure-contacting portion 542*b* of the shroud piece 3, and the press-fitted portion may be formed on further Y1 side with respect to the inner circumferential pressure-contacted portion 541*a* of the scroll piece 2.

Next, operational effects of the compressor housing 1 for a turbocharger according to the present embodiment will be described in detail.

According to the compressor housing 1 for a turbocharger of the present embodiment, the seal parts 541 and 542 between the scroll piece 2 and the shroud piece 3 are formed by pressure-contacting the pressure-contacting portions 541*b* and 542*b* that are provided on either one of the scroll piece 2 and the shroud piece 3 with the pressure-contacted portions 541*a* and 542*a* that are provided on the other one of the scroll piece 2 and the shroud piece 3 so as to cause plastic flow in the pressure-contacting portions 541*b* and 542*b*. Thus, micro gaps are filled by the plastic flow substantially of the pressure-contacting portions 541*b* and 542 *b* in the seal parts 541 and 542, so that improvement in sealability can be achieved in comparison with the case where the seal parts are formed by just press-fitting of both. In addition, because there is no need to apply any sealing material separately at the seal parts 541 and 542, cost reduction can be achieved.

The present embodiment includes the refrigerant flow path 5 that is formed along the diffuser part 30 in the circumferential direction, and allows a refrigerant for cooling the diffuser part to pass therethrough. The refrigerant flow path 5 is formed as an annular space 50 that is constituted by the first refrigerant flow-path formation part 51 of the scroll piece 2 and the second refrigerant flow-path formation part 52 of the shroud piece 3, the first refrigerant flow-path formation part 51 and the second refrigerant flow-path formation part 52 being formed respectively at each opposing part of the scroll piece 2 and the shroud piece 3 which oppose each other. This embodiment includes, as the seal parts 541 and 542, the inner circumferential seal part 541 configured to seal the refrigerant flow path 5 on the inner circumferential side thereof, and the outer circumferential seal part 542 configured to seal the refrigerant flow path 5 on the outer circumferential side thereof, and the inner circumferential seal part 541 is formed by pressure-contacting the inner circumferential pressure-contacting portion 541*b* that is provided on either one of the scroll piece 2 and the shroud piece 3 with the inner circumferential pressure-contacted portion 541*a* that is provided on the other one of the scroll piece 2 and the shroud piece 3 so as to cause plastic flow substantially in the inner circumferential pressure-contacting portion 541*b* to thereby form the seal part. The outer circumferential seal part 542 is formed by pressure-contacting the outer circumferential pressure-contacting portion 542*b* that is provided on either one of the scroll piece 2 and the shroud piece 3 with the outer circumferential pressure-contacted portion 542*a* that is provided on the other one of the scroll piece 2 and the shroud piece 3 so as to cause plastic flow substantially in the outer circumferential pressure-contacting portion 542*b* to thereby form the seal part. According to such configurations, in the compressor housing 1 for a turbocharger provided with the refrigerant flow path 5, the sealability at the inner circumferential seal part 541 and the outer circumferential seal part 542 can be achieved compatibly with cost reduction.

In the present embodiment, the inner circumferential pressure-contacting portion 541*b* is located on further rear side Y2 in the inserting direction of the press-fitting portion 53*b* with respect to the press-fitting portion 53*b*. Therefore, when the shroud piece 3 is assembled to the scroll piece 2, the inner circumferential pressure-contacting portion 541*b* is pressure-contacted with the inner circumferential pressure-contacted portion 541*a* after the press-fitting portion 53*b* is press-fitted, so that dispersal of a plastic flow portion at the inner circumferential seal part 541 can be curtailed. Thus, the sealability can be surely improved.

Furthermore, the compressor housing 1 for a turbocharger is dividably formed to include the scroll piece 2 and the shroud piece 3, and the scroll chamber 12 is defined by assembling at least both pieces. Thus, the scroll chamber 12 can be formed to have a circular cross section, and the scroll chamber formation part 120 can be formed into a shape having no undercut, which can be formed by die-cutting. As a result, the compression efficiency for the supplied air can be improved, and the scroll chamber can be easily formed by die casting.

Figure 8:
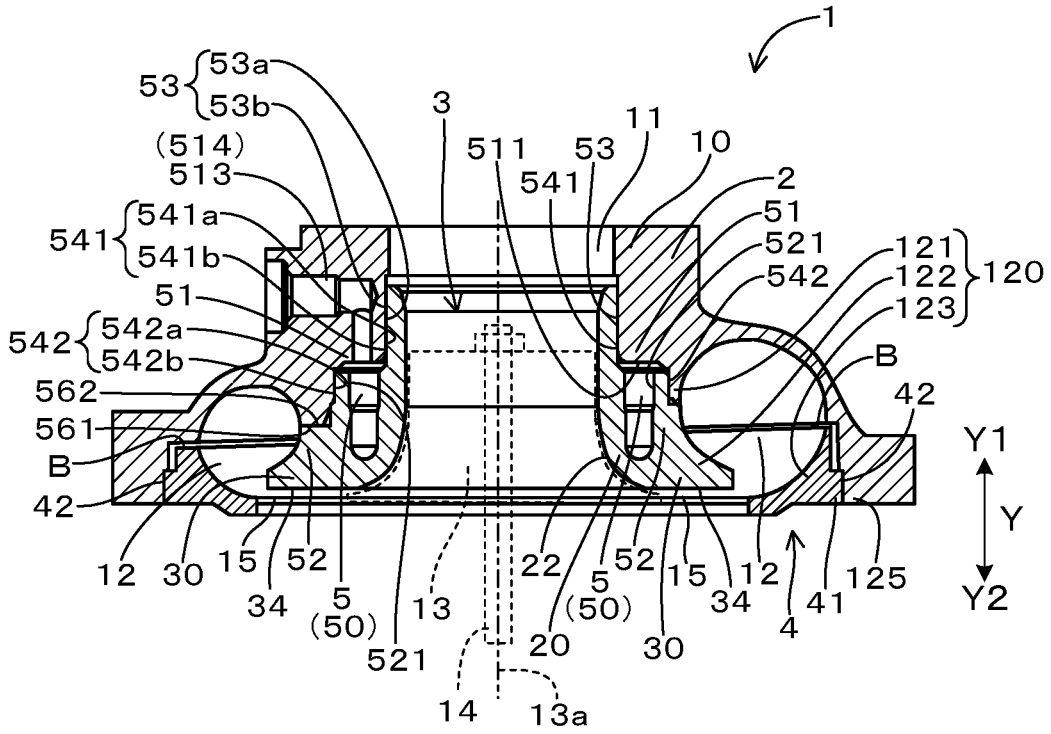
FIG. 8 is a cross-sectional view of a compressor housing for a turbocharger according to Modification 1.

It is noted that although in the present embodiment, the housing 1 for a turbocharger is of a two-piece structure that is composed of the scroll piece 2 and the shroud piece 3, the housing 1 may be of a three-piece structure that is composed of the scroll piece 2, the shroud piece 3, and an outer circumference annular piece 4 as in Modification 1 shown in FIG. 8. The outer circumference annular piece 4 forms an annular shape, and includes a third scroll chamber formation part 123 and an outer circumference annular piece insertion portion 410. The outer circumference annular piece insertion portion 410 is press-fitted into the outer peripheral portion 125 to form a press-fit part 42. Note that components in Modification 1 that are equivalent to those in Embodiment 1 are allotted with the same reference numerals to simplify the description.

Figure 9:
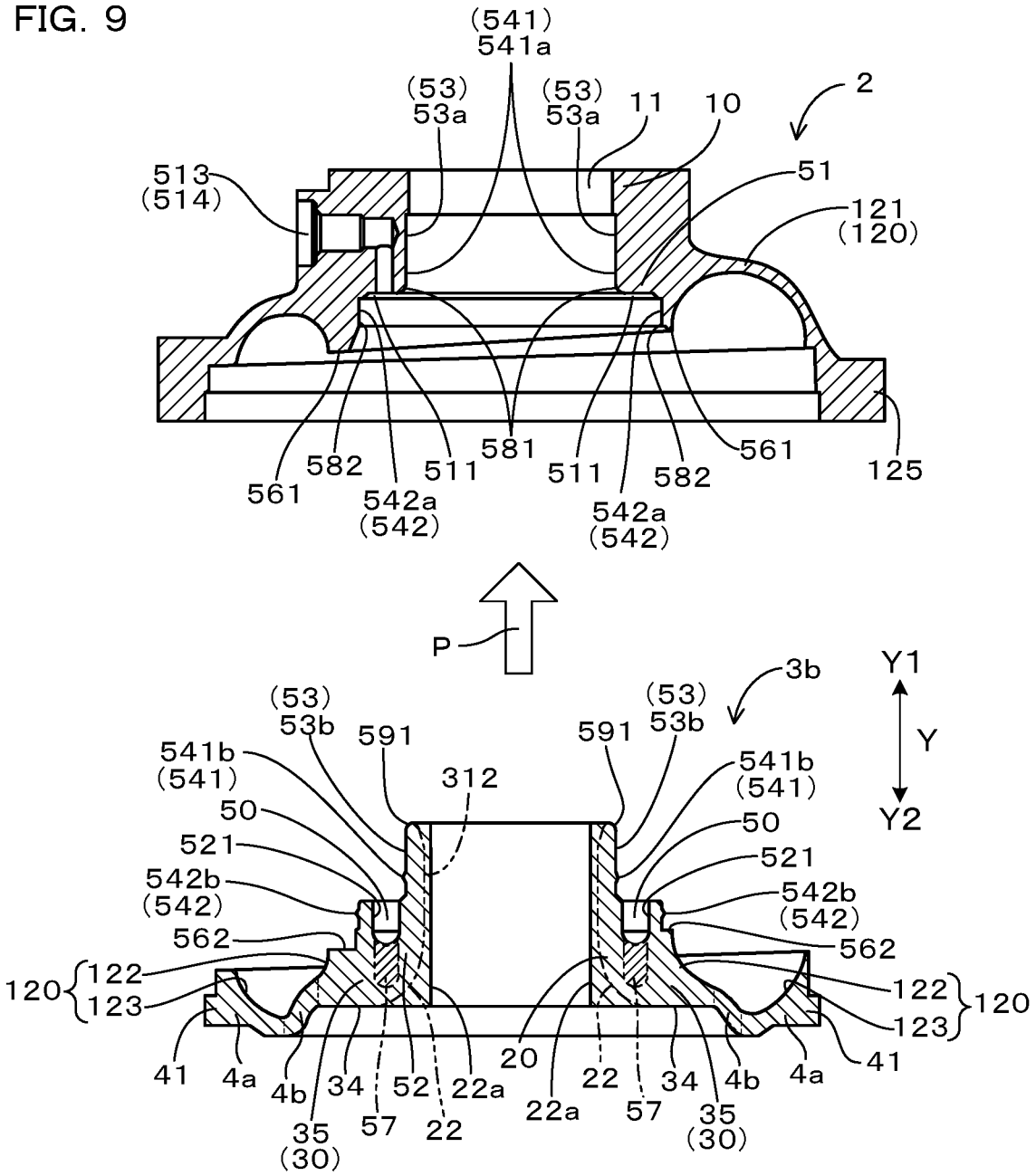
FIG. 9 is a schematic diagram for illustrating a method for manufacturing the compressor housing for a turbocharger according to Modification 1.

A method for manufacturing the compressor housing 1 for a turbocharger according to Modification 1 will be described hereinafter. First of all, as shown in FIG. 9, the scroll piece 2 is molded by die-casting in the same way as in Embodiment 1. And, an integral piece 3*b* is molded by die casting. The integral piece 3*b* is composed of the outer peripheral portion of the shroud piece 3 in Embodiment 1 and the inner circumference part of an outer circumference annular piece 4 with a contour of the outer circumference annular piece 4 both of which are integrated through a connecting portion 4*a*. Then, by machining, the press-fitted portion 53*a*, the inner circumferential pressure-contacted portion 541*a*, and the outer circumferential pressure-contacted portion 542*a* are formed on the scroll piece 2, and the press-fitting portion 53*b*, the inner circumferential pressure-contacting portion 541*b*, and the outer circumferential pressure-contacting portion 542*b* are formed on the shroud piece 3. And then, the cut part 57 that is a bottom portion of the second wall surface 521 is cut. Thereafter, the press-fitting portion 53*b* of the integral piece 3*b* is press-fitted into the press-fitted portion 53*a* of the scroll piece 2 in the direction of the arrow P, and the inner circumferential pressure-contacting portion 541*b* and the outer circumferential pressure-contacting portion 542*b*, of the integral piece 3*b* are pressure-contacted with the inner circumferential pressure-contacted portion 541*a* and the outer circumferential pressure-contacted portion 542*a* so as to cause plastic flow in the inner circumferential pressure-contacting portion 541*b* and the outer circumferential pressure-contacting portion 542*b* so that the inner circumferential seal part 541 and the outer circumferential seal part 542 are formed. Then, by cutting off the connecting portion 4*b* shown in FIG. 10, the shroud piece 3 and the outer circumference annular piece 4 are separated from each other under the state in which the shroud piece 3 and the outer circumference annular piece 4 are press-fitted into the scroll piece 2. In this way, the housing 1 for a turbocharger according to Modification 1 is produced.

The housing 1 for a turbocharger according to Modification 1 also exhibits operational effects equivalent to those in Embodiment 1. A tightening margin of the press-fit part 42 into which the outer circumference annular piece 4 is press-fitted is preferably set smaller than that of the inner circumferential seal part 53*b*. In this case, the integral piece 3*b* can be easily press-fitted into the scroll piece 2. In addition, misalignment between the press-fitting portion 53*b* of the shroud piece 3 and the press-fitting portion 42 of the outer circumference annular piece 4 can be absorbed.

Figure 10:
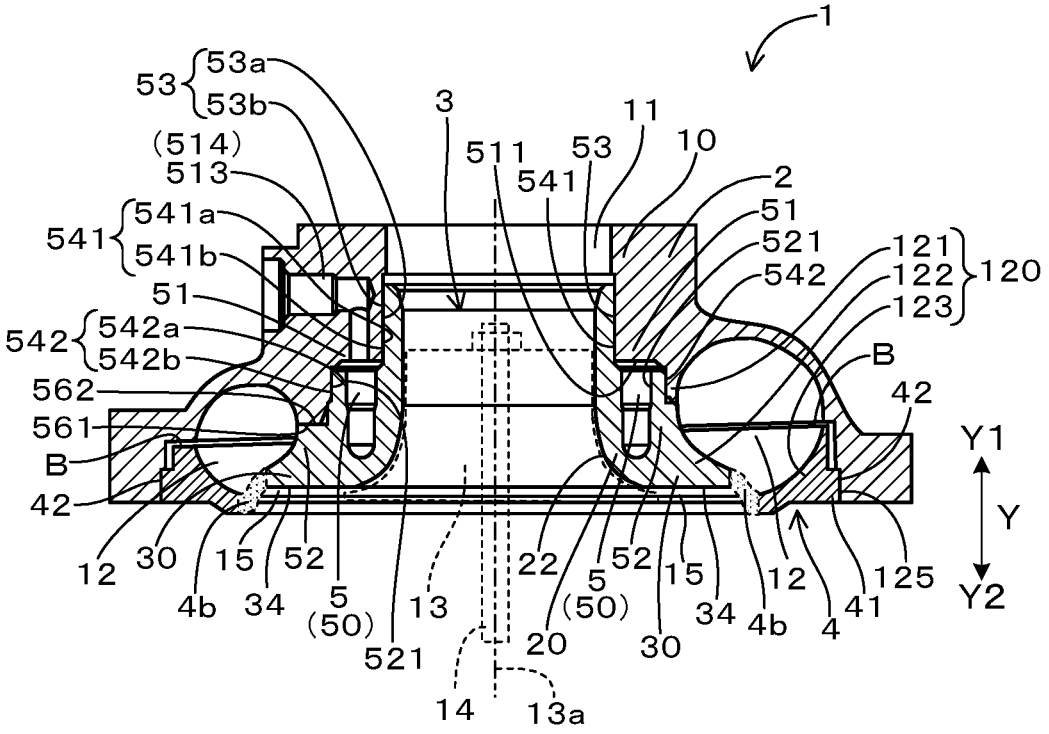
FIG. 10 is a schematic diagram for illustrating a method for manufacturing the compressor housing for a turbocharger according to Modification 1.

In the housing 1 for a turbocharger according to Modification 1, a part of the integrated piece 3*b* for constituting the outer circumference annular piece 4 is not brought into contact with the scroll piece 2 in the shaft direction S2 so as to form a gap B, as shown in FIGS. 8 and 10. Therefore, the first contact surface 561 can be brought in contact with the second contact surface 562 when the integral piece 3*b* is press-fitted. Consequently, the integral piece 3*b* can be positioned further accurately when being press-fitted in the shaft direction. In other words, the shroud piece 3 can be positioned further accurately in the shaft direction for completion.

Embodiment 2

In Embodiment 1, the inner circumferential pressure-contacting portion 541*b* in the non-assembled state protrudes in the radial direction in a cross section including the rotation axis 13*a* of the compressor impeller 13 to form a mountain shape, as shown in FIG. 6A. In the mountain shape, a front-end side inclined plane that is located on the front-end side in the inserting direction of the press-fitting portion 53*b* and a rear-end side inclined plane that is located on the rear-end side in the inserting direction are symmetric with respect to the peak of the mountain shape, and the inclination angles of the both planes are equivalent. Further, in Embodiment 1, the outer circumferential pressure-contacting portion 542*b* in the non-assembled state is configured similarly to the inner circumferential pressure-contacting portion 541*b*, as shown in FIG. 7A.

Figure 11:
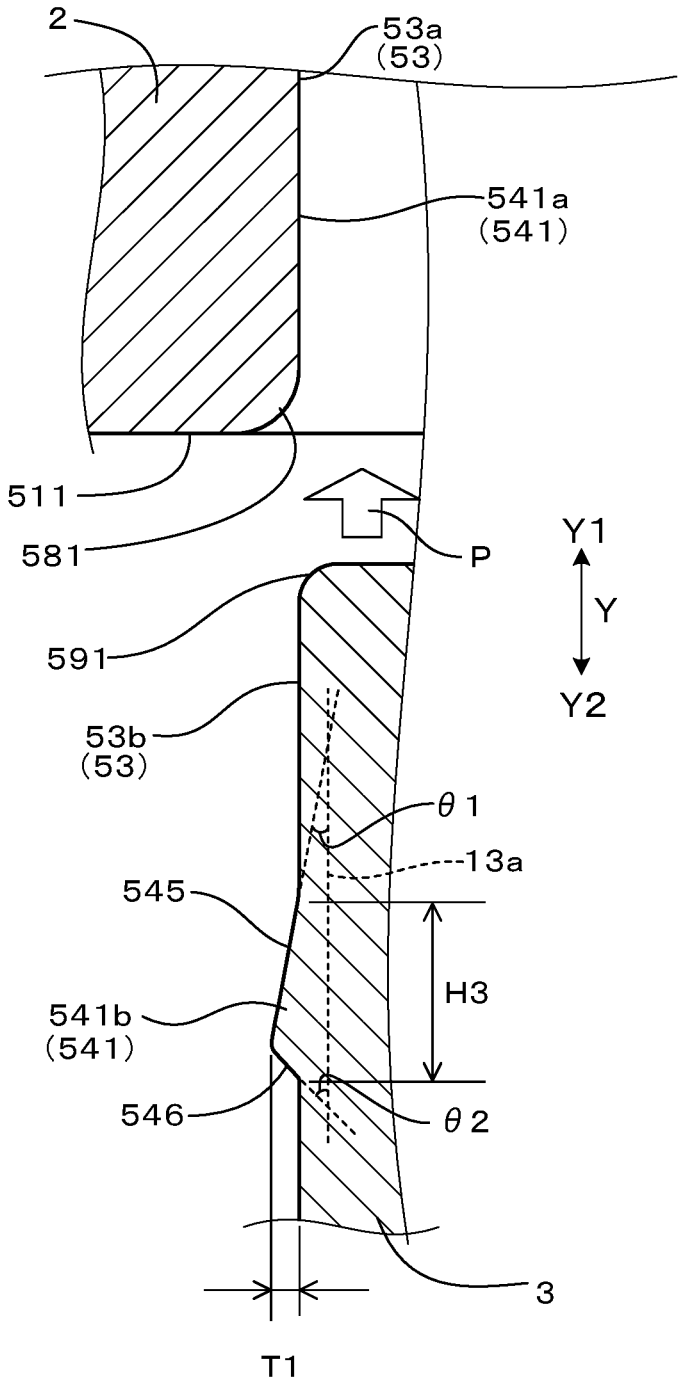
FIG. 11 is a schematic diagram of an enlarged substantial part for illustrating a method for manufacturing a compressor housing for a turbocharger according to Embodiment 2.

According to Embodiment 2, instead of the above-mentioned configurations, the inner circumferential pressure-contacting portion 541*b* in the non-assembled state is formed in a mountain shape that protrudes in the radial direction X in a cross section including the rotation axis 13*a* of the compressor impeller 13, and has a front-end side inclined plane 545 that is located on the front-end side in the press-fitting portion inserting direction (on the intake side Y1 in the present embodiment) and a rear-end side inclined plane 546 that is located on the rear-end side in the inserting direction (on the opposite side Y2 to the intake side Y1 in the present embodiment), as shown in FIG. 11. In the above-mentioned cross section, an acute-angle θ2 between the rear-end side inclined plane 546 and the rotation axis 13*a* is set larger than an acute-angle θ1 between the front-end side inclined plane 545 and the rotation axis 13*a*. And, a formation range H3 for the inner circumferential pressure-contacting portion 541*b* that is shown in FIG. 11 is smaller than the formation range H1 in Embodiment 1 that is shown in FIG. 6A. In the present embodiment, the protrusion amount T1 of the inner circumferential pressure-contacting portion 541*b*, which is shown in FIG. 11, is set the same as that in Embodiment 1. It is noted that the rotation axis 13*a* shown in FIG. 11 is imaginarily moved in parallel to the vicinity of the inner circumferential pressure-contacting portion 541*b* for the purpose of description, thus FIG. 11 does not show the actual position of the rotation axis 13*a*. However, θ1 shown in FIG. 11 represents the acute angle of the front-end side inclined plane 545 with respect to the rotation axis 13*a* actually located, and θ2 shown in FIG. 11 represents the acute angle of the rear-end side inclined plane 546 with respect to the rotation axis 13*a* actually located.

The acute-angle θ1 formed between the front-end side inclined plane 545 and the rotation axis 13*a* in FIG. 11 may be set, for example, to 5°-15°, and is set to 10° in the present embodiment. The acute-angle θ2 formed between the rear-end side inclined plane 546 and the rotation axis 13*a* in FIG. 11 may be set, for example, to 30°-60°, and is set to 45° in the present embodiment. Both of θ1 and θ2 are constant entirely in the circumferential direction.

Figure 12:
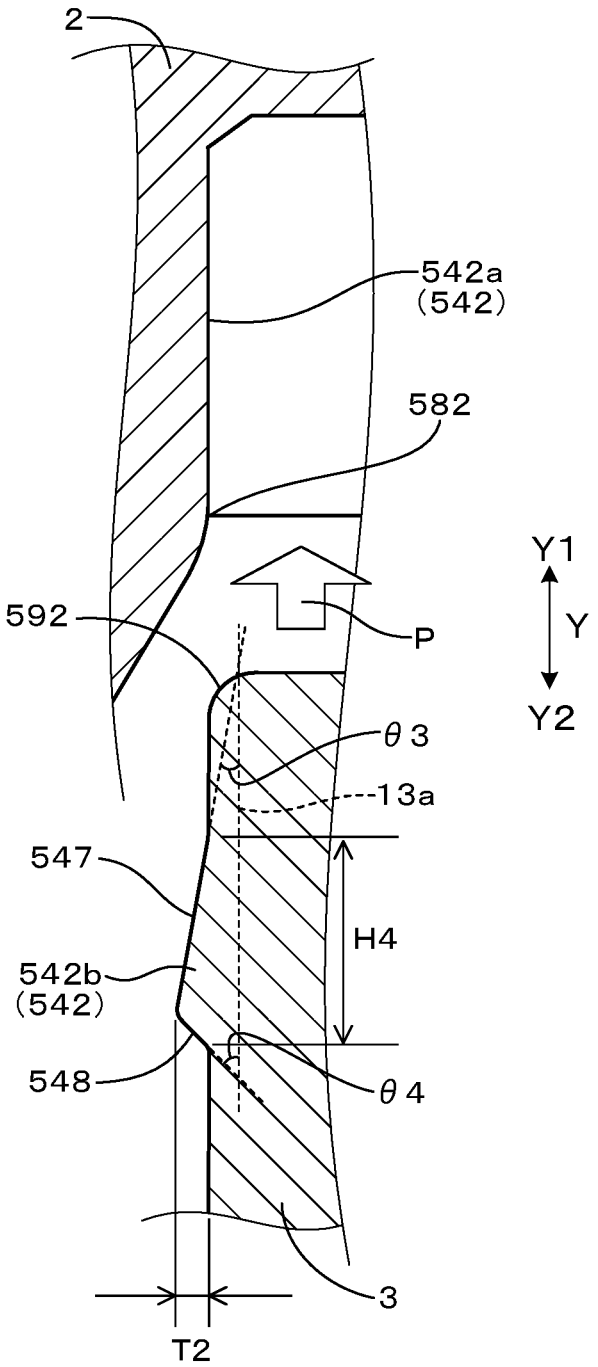
FIG. 12 is a schematic diagram of an enlarged substantial part for illustrating the method for manufacturing the compressor housing for a turbocharger according to Embodiment 2.

As shown in FIG. 12, the outer circumferential pressure-contacting portion 542*b* in the non-assembled state is also formed in a mountain shape that protrudes in the radial direction X in a cross section including the rotation axis 13*a* in the same manner as in the inner circumferential pressure-contacting portion 541*b*, and has a front-end side inclined plane 547 that is located on the front-end side in the inserting direction (on the intake side Y1 in the present embodiment) and a rear-end side inclined plane 548 that is located on the rear-end side in the inserting direction (on the opposite side Y2 to the intake side Y1 in the present embodiment). In the above-mentioned cross section, an acute-angle θ4 between the rear-end side inclined plane 548 and the rotation axis 13*a* is set larger than an acute-angle θ3 between the front-end side inclined plane 547 and the rotation axis 13*a*. And, a formation range H4 for the outer circumferential pressure-contacting portion 542*b* that is shown in FIG. 12 is smaller than the formation range H2 in Embodiment 1 that is shown in FIG. 7A. And, the protrusion amount T2 of the outer circumferential pressure-contacting portion 542*b*, which is shown in FIG. 12, is set the same as that in Embodiment 1. It is noted that the rotation axis 13*a* shown in FIG. 12 is imaginarily moved in parallel to the vicinity of the outer circumferential pressure-contacting portion 542*b* for the purpose of description, thus FIG. 12 does not show the actual position of the rotation axis 13*a*. However, θ3 shown in FIG. 12 represents the acute angle of the front-end side inclined plane 547 with respect to the rotation axis 13*a* actually located, and θ4 shown in FIG. 12 represents the acute angle of the rear-end side inclined plane 548 with respect to the rotation axis 13*a* actually located.

The acute-angle θ3 formed between the front-end side inclined plane 547 and the rotation axis 13*a* in FIG. 12 may be set, for example, to 5°-15° as with the acute-angle θ1, and is set to 10° in the present embodiment. The acute-angle θ4 formed between the rear-end side inclined plane 548 and the rotation axis 13*a* may be set, for example, to 30°-60°, as with the acute-angle θ2, and is set to 45° in the present embodiment. Both of θ3 and θ4 are constant entirely in the circumferential direction. It is noted that other configurations in the present embodiment are equivalent to those in Embodiment 1, and the same reference numerals as those in Embodiment 1 are allotted to simplify the description.

Next, a method for manufacturing the compressor housing 1 for a turbocharger according to Embodiment 2 will be described.

First of all, the scroll piece 2 and the shroud piece precursor 3*a* are separately molded by die casting in the same manner as in Embodiment 1 shown in FIG. 2. Then, machining is performed in the same manner as in Embodiment 1. However, in the present embodiment, the inner circumferential pressure-contacting portion 541*b* and the outer circumferential pressure-contacting portion 542*b* are formed by machining in a mountain shape that protrudes in the radial direction, having front-end side inclined planes 545 and 547 that are located on the front-end side Y1 in the press-fitting portion inserting direction of the press-fitting portion and rear-end side inclined planes 546 and 548 that are located on the rear-end side Y2 in the inserting direction such that in the cross section, the acute-angle θ2 between the rear-end side inclined plane 546 and the rotation axis 13*a*, and the acute-angle θ4 between the rear-end side inclined plane 548 and the rotation axis 13*a* are set larger than the acute-angle θ1 between the front-end side inclined plane 545 and the rotation axis 13*a*, and the acute-angle θ3 between the front-end side inclined plane 547 and the rotation axis 13*a*, respectively. And, in the present embodiment, as mentioned above, θ1 and θ3 are set to 10°, and θ2 and θ4 are set to 45°. Then, the assembling step is performed in the same manner as in Embodiment 1 so as to cause plastic flow in the inner circumferential pressure-contacting portion 541*b* and the outer circumferential pressure-contacting portion 542*b* to thereby form the inner circumferential seal part 541 and the outer circumferential seal part 542. In this way, the refrigerant flow path 5 is formed. Then, the inside surface 22*a* is machined to form the shroud surface 22. Thus, the compressor housing 1 for a turbocharger is manufactured.

The compressor housing 1 for a turbocharger of Embodiment 2 exhibits the same operational effects as in Embodiment 1. Further, in the method for manufacturing the compressor housing 1 for a turbocharger according to the present embodiment, the inner circumferential pressure-contacting portion 541*b* and the outer circumferential pressure-contacting portion 542*b* are each formed by machining in a mountain shape that protrudes in the radial direction in a cross section including the rotation axis 13*a*, having the front-end side inclined planes 545 and 547 respectively that are located on the front-end side in the inserting direction of the press-fitting portion and the rear-end side inclined planes 546 and 548 respectively that are located on the rear-end side in the inserting direction such that in the cross section, the acute-angles θ2 and θ4 of the rear-end side inclined plane 546 and 548 are respectively set larger than the acute-angles θ1 and θ3 of the front-end side inclined planes 545 and 547. In this way, at the pressure-contacting portions 541*b* and 542*b*, the rear-end side inclined planes 546 and 548 are machined to stand more steeply with respect to the rotational axis 13*a* respectively than the front-end side inclined planes 545 and 547. Consequently, the formation ranges (i.e. the widths) H3 and H4 respectively of the pressure-contacted portions 541*b* and 542*b* can be narrowed while the inclination angles θ1 and θ3 respectively of the front-end side inclined planes 545 and 547, and the protrusion amounts T1 and T2 respectively of the pressure-contacted portions 541*b* and 542*b* are set to be the same as in Embodiment 1. Therefore, plastic flow in the pressure-contacting portions 541*b* and 542*b* can be easily caused without deterioration of assemblability. Consequently, at each seal part 541 and 542, a micro gap can be filled more surely, so that the sealability can be further improved. Otherwise, when plastic flow amounts at the pressure-contacting portions 541*b* and 542*b* are set to the same as in Embodiment 1, dimension tolerances in the pressure-contacting portions 541*b* and 542*b*, and the pressure-contacted portions 541*a* and 542*a* in machining can be eased by narrowing the widths H3 and H4 of the pressure-contacting portions. As a result, productivity can be improved and cost reduction can be achieved.

In the present embodiment, the shroud piece 3 is provided with the inner circumferential pressure-contacting portion 541*b*, and the scroll piece 2 is provided with the inner circumferential pressure-contacted portion 541*a*, however, instead of such a configuration, the inner circumferential pressure-contacted portion 541*a* may be provided on the shroud piece 3, and the inner circumferential pressure-contacting portion 541*b* may be provided on the scroll piece 2. Further, in the present embodiment, the shroud piece 3 is provided with the outer circumferential pressure-contacting portion 542*b*, and the scroll piece 2 is provided with the outer circumferential pressure-contacted portion 542*a*, however, instead of such a configuration, the outer circumferential pressure-contacted portion 542*a* may be provided on the shroud piece 3, and the outer circumferential pressure-contacting portion 542*b* may be provided on the scroll piece 2. In both cases, it is preferable to provide the inner circumferential pressure-contacted portion 541*a*, and the outer circumferential pressure-contacted portion 542*a* on either piece that has a higher rigidity than the other does.

It is noted that in the present embodiment, the inner circumferential pressure-contacting portion 541*b* and the outer circumferential pressure-contacting portion 542*b* are provided on the shroud piece 3 as shown in FIGS. 11 and 12, so that the front-end side inclined planes 545 and 547 are located on the intake side Y1, and the rear-end side inclined planes 546 and 548 are located on the opposite side Y2. On the other hand, when the inner circumferential pressure-contacting portion 541*b* and the outer circumferential pressure-contacting portion 542*b* are provided on the scroll piece 2, the intake side Y1 shifts to the rear-end side in the inserting direction, and the opposite side Y2 shifts to the front-end side in the inserting direction, so that the rear-end side inclined planes 546 and 548 are located on the intake side Y1, and the front-end side inclined planes 545 and 547 are located on the opposite side Y2.

It is noted that in the present embodiment, the front-end side inclined planes 545 and 547, and the rear-end side inclined planes 546 and 548 are formed to have a shape that is shown by a straight line when viewed in the cross section including the rotation axis 13*a*, however, it is not necessary for the line to be an exact straight line in the cross section, and the line may be slightly curved.

The present disclosure is not limited to the above-mentioned embodiments and modifications, and can be applied to various embodiments within the range that does not depart from the gist of the present disclosure.

The invention claimed is:

1. A compressor housing for a turbocharger configured to house a compressor impeller, the compressor housing comprising:

an intake port part that defines an intake port configured to suck in air toward the compressor impeller;

a shroud part that surrounds the compressor impeller in a circumferential direction and has a shroud surface facing the compressor impeller;

a diffuser part that is on an outer circumferential side of the compressor impeller in the circumferential direction and forms a diffuser passage configured to allow compressed air discharged from the compressor impeller to pass therethrough; and a scroll chamber part that forms a scroll chamber configured to guide the compressed air passing through the diffuser passage to outside;

wherein the compressor housing is dividably composed of a plurality of pieces including a scroll piece having at least the intake port part and a portion of the scroll chamber part, and a shroud piece having at least a portion of the scroll chamber part, a portion of the diffuser part, and the shroud part, wherein the scroll piece and the shroud piece are assembled to each other by press-fitting a press-fitting portion of the shroud piece into a press-fitted portion of the scroll piece, and wherein a seal part that seals the scroll piece and the shroud piece comprises a pressure-contacting portion on one of the scroll piece and the shroud piece and a pressure-contacted portion on the other one of the scroll piece and the shroud piece that are in pressure contact with one another such that there is plastic deformation in the pressure-contacting portion.

2. The compressor housing for a turbocharger according to claim 1, further comprising a refrigerant flow path that is along the diffuser part in the circumferential direction, and allows a refrigerant for cooling the diffuser part to pass therethrough;

wherein the refrigerant flow path is an annular space that comprises a first refrigerant flow-path part of the scroll piece and a second refrigerant flow-path part of the shroud piece, the first refrigerant flow-path part and the second refrigerant flow-path part respectively at each opposing part of the scroll piece and the shroud piece which oppose each other, wherein the seal part includes an inner circumferential seal part configured to seal the refrigerant flow path on the inner circumferential side thereof, and an outer circumferential seal part configured to seal the refrigerant flow path on the outer circumferential side thereof, wherein the inner circumferential seal part is formed by pressure-contacting an inner circumferential pressure-contacting portion that is on either one of the scroll piece and the shroud piece with an inner circumferential pressure-contacted portion that is on the other one of the scroll piece and the shroud piece so that the inner circumferential pressure-contacting portion plastically flows, and wherein the outer circumferential seal part comprises an outer circumferential pressure-contacting portion that is on either one of the scroll piece and the shroud piece and an outer circumferential pressure-contacted portion that is on the other one of the scroll piece and the shroud piece that are in pressure contact with one another such that there is plastic deformation in the outer circumferential pressure-contacting portion.

3. The compressor housing for a turbocharger according to claim 1, wherein the seal part is located within the press-fitting portion on a further rear side in an inserting direction of the press-fitting portion.

4. The compressor housing for a turbocharger according to claim 2, wherein the seal part is located within the press-fitting portion on a further rear side in an inserting direction of the press-fitting.

5. A method for manufacturing a compressor housing for a turbocharger according to claim 1, the method comprising:

molding the scroll piece and the shroud piece by die-casting;

forming the pressure-contacting portion on either one of the scroll piece and the shroud piece and the pressure-contacted portion on the other one of the scroll piece and the shroud piece by machining; and assembling the shroud piece to the scroll piece by press-fitting the press-fitting portion into the press-fitted portion, and by pressure-contacting the pressure-contacting portion with the pressure-contacted portion so as to cause plastic deformation in the pressure-contacting portion to thereby form the seal part.

6. A method for manufacturing a compressor housing for a turbocharger according to claim 2, the method comprising:

molding the scroll piece and the shroud piece by die-casting;

forming the pressure-contacting portion on either one of the scroll piece and the shroud piece and the pressure-contacted portion on the other one of the scroll piece and the shroud piece by machining; and assembling the shroud piece to the scroll piece by press-fitting the press-fitting portion into the press-fitted portion, and by pressure-contacting the pressure-contacting portion with the pressure-contacted portion so as to cause plastic deformation in the pressure-contacting portion to thereby form the seal part.

7. A method for manufacturing a compressor housing for a turbocharger according to claim 3, the method comprising:

molding the scroll piece and the shroud piece by die-casting;

forming the pressure-contacting portion on either one of the scroll piece and the shroud piece and the pressure-contacted portion on the other one of the scroll piece and the shroud piece by machining; and assembling the shroud piece to the scroll piece by press-fitting the press-fitting portion into the press-fitted portion, and by pressure-contacting the pressure-contacting portion with the pressure-contacted portion so as to cause plastic deformation in the pressure-contacting portion to thereby form the seal part.

8. A method for manufacturing a compressor housing for a turbocharger according to claim 4, the method comprising:

molding the scroll piece and the shroud piece by die-casting;

forming the pressure-contacting portion on either one of the scroll piece and the shroud piece and the pressure-contacted portion on the other one of the scroll piece and the shroud piece by machining; and assembling the shroud piece to the scroll piece by press-fitting the press-fitting portion into the press-fitted portion, and by pressure-contacting the pressure-contacting portion with the pressure-contacted portion so as to cause plastic deformation in the pressure-contacting portion to thereby form the seal part.

9. The method according to claim 5, wherein the pressure-contacting portion is formed by machining in a mountain shape that protrudes in the radial direction in a cross section including the rotation axis of the compressor impeller, having a front-end side inclined plane that is located on the front-end side in a press-fitting portion inserting direction and a rear-end side inclined plane that is located on the rear-end side in the inserting direction such that an acute-angle between the rear-end side inclined plane and the rotation axis is set larger than an acute-angle between the front-end side inclined plane and the rotation axis in the cross section.

10. The method according to claim 6, wherein the pressure-contacting portion is formed by machining in a mountain shape that protrudes in the radial direction in a cross section including the rotation axis of the compressor impeller, having a front-end side inclined plane that is located on the front-end side in a press-fitting portion inserting direction and a rear-end side inclined plane that is located on the rear-end side in the inserting direction such that an acute-angle between the rear-end side inclined plane and the rotation axis is set larger than an acute-angle between the front-end side inclined plane and the rotation axis in the cross section.

11. The method according to claim 7, wherein the pressure-contacting portion is formed by machining in a mountain shape that protrudes in the radial direction in a cross section including the rotation axis of the compressor impeller, having a front-end side inclined plane that is located on the front-end side in a press-fitting portion inserting direction and a rear-end side inclined plane that is located on the rear-end side in the inserting direction such that an acute-angle between the rear-end side inclined plane and the rotation axis is set larger than an acute-angle between the front-end side inclined plane and the rotation axis in the cross section.

12. The method according to claim 8, wherein the pressure-contacting portion is formed by machining in a mountain shape that protrudes in the radial direction in a cross section including the rotation axis of the compressor impeller, having a front-end side inclined plane that is located on the front-end side in a press-fitting portion inserting direction and a rear-end side inclined plane that is located on the rear-end side in the inserting direction such that an acute-angle between the rear-end side inclined plane and the rotation axis is set larger than an acute-angle between the front-end side inclined plane and the rotation axis in the cross section.

* * * * *